US008172553B2

(12) United States Patent
Horng et al.

(10) Patent No.: US 8,172,553 B2
(45) Date of Patent: May 8, 2012

(54) SMALL SIZED HEAT DISSIPATING FAN WITH OUTWARD ARRANGEMENT OF A SPEED ADJUSTER RESISTOR HAVING A RESISTANCE OF ZERO OHMS

(75) Inventors: Alex Horng, Kaohsiung (TW); Tsung-Hsin Cheng, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 482 days.

(21) Appl. No.: 12/270,915

(22) Filed: Nov. 14, 2008

(65) Prior Publication Data

US 2010/0098561 A1 Apr. 22, 2010

(30) Foreign Application Priority Data

Oct. 22, 2008 (TW) ..... 97218848 U

(51) Int. Cl.
*F04B 49/00* (2006.01)

(52) U.S. Cl. ..... 417/354; 310/68 R; 29/888.025; 417/53

(58) Field of Classification Search ..... 417/354, 417/423.1, 423.7, 53; 310/156.05, 156.06, 310/67 R, 68 B, 68 A, 68 C, 68 R; 29/888.025
See application file for complete search history.

(56) References Cited

U.S. PATENT DOCUMENTS

| | | | | |
|---|---|---|---|---|
| 5,343,104 | A * | 8/1994 | Takahashi et al. | 310/90 |
| 6,396,032 | B1 * | 5/2002 | Denny et al. | 219/501 |
| 6,841,957 | B2 * | 1/2005 | Brown | 318/400.01 |
| 7,903,406 | B2 * | 3/2011 | Takemoto | 361/695 |
| 2007/0122293 | A1 * | 5/2007 | Sugiyama et al. | 417/354 |
| 2008/0283216 | A1 * | 11/2008 | Horng et al. | 165/47 |

OTHER PUBLICATIONS

Murata Chip Trimmer Potentiometer Manual, 1997.*
Fan Speed Control, http://www.bearblain.com/fan_speed_control.htm, dated Jan. 5, 2008.*
Potentiometer vendor sheet, dated 2003.*
Keeping the Fans Quiet—Power Control Methods, http://www.procooling.com/index.php?func=articles&disp=54&pg=1, dated Oct. 25, 2001.*
What power rating do I need for my potentiometer?, http://ask.metafilter.com/26323/What-power-rating-do-I-need-for-my-potentiomter, dated Oct. 29, 2005.*
Yageo Phicomp, RC high power series (Chip Resistor Surface Mount) (sizes 0603/0805/1206/2512), Data Sheet, Dec. 14, 2010, 8 pages, Version 0, Yageo.
Welwyn Components Limited, Thick Film High Power Chip Resistor—WHPC Series, data sheet, 4 pages, Welwyn Components.

* cited by examiner

*Primary Examiner* — Charles Freay
*Assistant Examiner* — Nathan Zollinger
(74) *Attorney, Agent, or Firm* — Alan Kamrath; Kamrath IP Lawfirm, PA

(57) ABSTRACT

A small sized heat dissipating fan includes a housing, a stator and a rotor. The housing includes a carrying base to hold the stator and rotor. The stator includes a magnetizing member having a plurality of coils and a circuit board electrically connecting to the coils and having a driving circuit and a speed adjuster. The driving circuit, the speed adjuster and the coils electrically connect to each other. The rotor includes a shaft, an impeller fixed to one end of the shaft, and an annular magnet. The other end of the shaft extends through the magnetizing member. The shaft is rotatably coupled to the stator. The annular magnet is mounted to an inner periphery of the impeller and faces the magnetizing member of the stator. Consequently, by adjustment of resistance of the speed adjuster, the rated rotational speed of the heat dissipating fan can be changed.

5 Claims, 4 Drawing Sheets

SMALL SIZED HEAT DISSIPATING FAN WITH OUTWARD ARRANGEMENT OF A SPEED ADJUSTER RESISTOR HAVING A RESISTANCE OF ZERO OHMS

BACKGROUND OF THE INVENTION

1. Field of the Invention

The present invention relates to a heat dissipating fan and, more particularly, to a small sized heat dissipating fan including a speed adjuster to adjust rotational speed of the small sized heat dissipating fan.

2. Description of the Related Art

Referring to FIG. 1, a conventional small sized heat dissipating fan is shown. The conventional small sized heat dissipating fan includes a housing 7, a stator 8 and a rotor 9, with the housing 7 receiving the stator 8 and the rotor 9. The housing 7 has a base 71 where the stator 8 and the rotor 9 are mounted. The stator 8 fixed to the base 71 has a magnetizing member 81 with a plurality of windings 811 and a circuit board 82 electrically connecting to the windings 811, such that a rated voltage provided by a power supply can generate a current passing through the winding 811 to generate alternating magnetic fields. The rotor 9 has a shaft 91, an impeller 92 and a magnet 93. One end of the shaft 91 is fixed to the center of the impeller 92 and the other end of the shaft 91 extends through the magnetizing member 81, with the shaft 91 being rotatably coupled to the stator 8. The magnet 93 is mounted to an inner surface of the impeller 92 and faces the magnetizing member 81 of the stator 8 to react with the alternating magnetic fields generated from the windings 811, so that the rotor 9 can be driven to rotate relative to the stator 8. In general, the rotor 9 of the conventional small sized heat dissipating fan is driven to rotate by the current through the windings 811 from the rated voltage via the circuit board 82. Therefore, the rotor 9 rotates at a fixed rated rotational speed after being actuated.

However, when a need for decreasing the rated rotational speed is required, turns of the windings 811 of the magnetizing member 81 should be changed or the circuit board 82 should be replaced with another circuit board providing a rated voltage smaller than that of the circuit board 82. In order to produce the conventional small sized heat dissipating fans of various rated rotational speeds, a manufacturer of the conventional small sized heat dissipating fan has to make a large quantity of the magnetizing members 81 or circuit boards 82 of various kinds. As a result, the production cost can not be reduced, and there may be a risk of slow selling. Hence, there is a need for an improvement over the conventional small sized heat dissipating fan.

SUMMARY OF THE INVENTION

It is therefore the primary objective of this invention to provide a small sized heat dissipating fan including a changeable or adjustable speed adjuster that overcomes the problems of the prior art described above to change rotational speed of the small sized heat dissipating fan.

A small sized heat dissipating fan according to the preferred teachings of the present invention includes a housing, a stator and a rotor. The housing includes an air inlet, an air outlet and a carrying base arranged in the housing. The air inlet and the air outlet are formed on any two side walls of the housing. The stator is securely mounted on the carrying base and includes a magnetizing member having a plurality of coils, and a circuit board. The circuit board electrically connects to the coils and has a driving circuit and a speed adjuster.

The driving circuit, the speed adjuster and the coils electrically connect to each other. The rotor includes a shaft, an impeller and an annular magnet. One end of the shaft is fixed to the impeller and the other end of the shaft extends through the magnetizing member of the stator. The shaft is rotatably coupled to the stator. The annular magnet is mounted to an inner periphery of the impeller and faces the magnetizing member of the stator. Accordingly, intensity of an alternating magnetic field created by the coils can be changed by adjustment of resistance of the speed adjuster, so that the rated rotational speed of the heat dissipating fan is changed.

In an example, the speed adjuster is arranged out of an outer radial edge of the magnetizing member. Accordingly, without an obstruction caused by the magnetizing member, adjustment or replacement of the speed adjuster can be easily completed.

Further scope of the applicability of the present invention will become apparent from the detailed description given hereinafter. However, it should be understood that the detailed description and specific examples, while indicating preferable embodiments of the invention, are given by way of illustration only, since various modifications will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
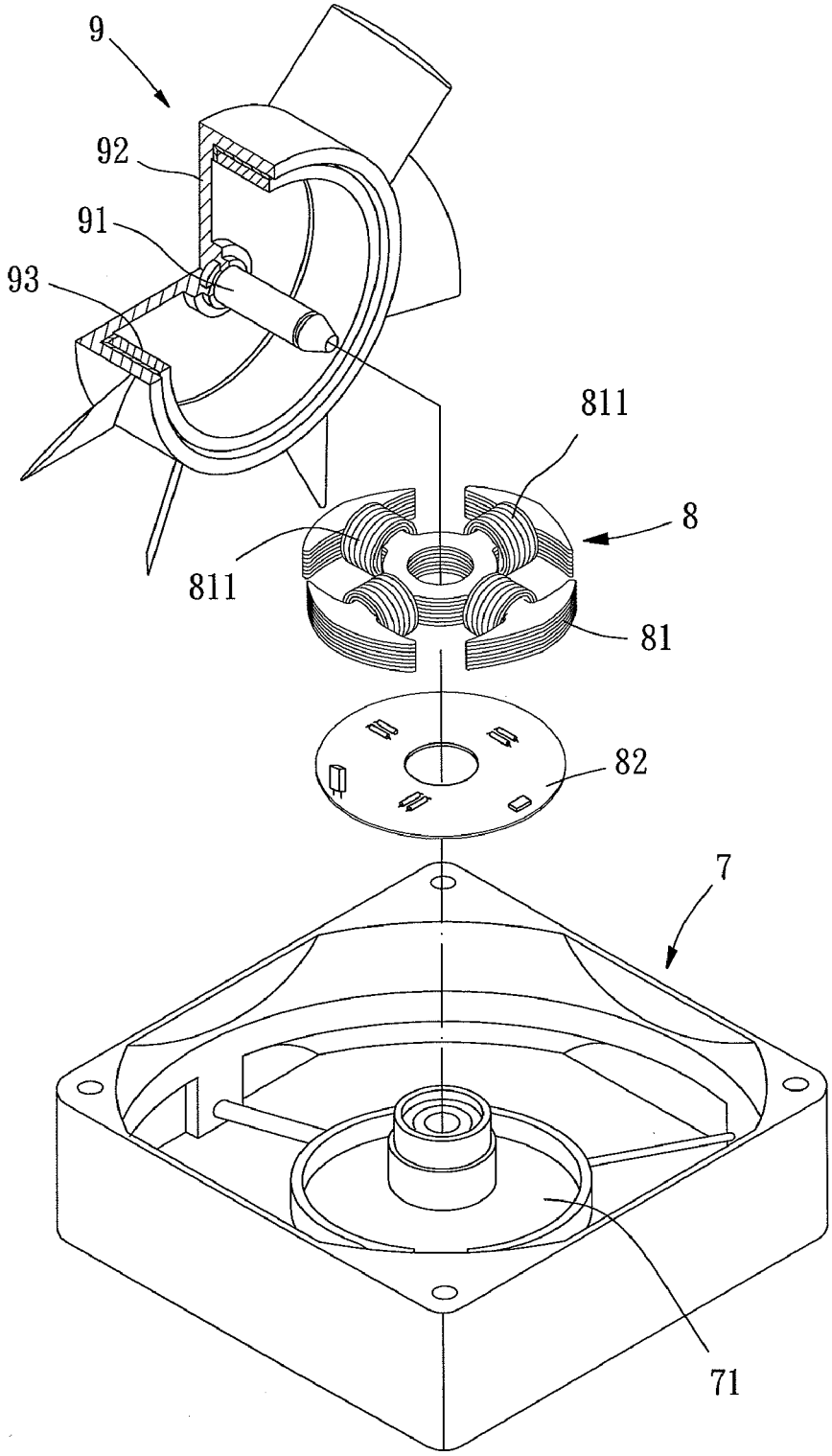
FIG. 1 PRIOR ART
FIG. 1 is an exploded perspective view illustrating a conventional small sized heat dissipating fan including an outer-rotor-type motor.
Figure 2:
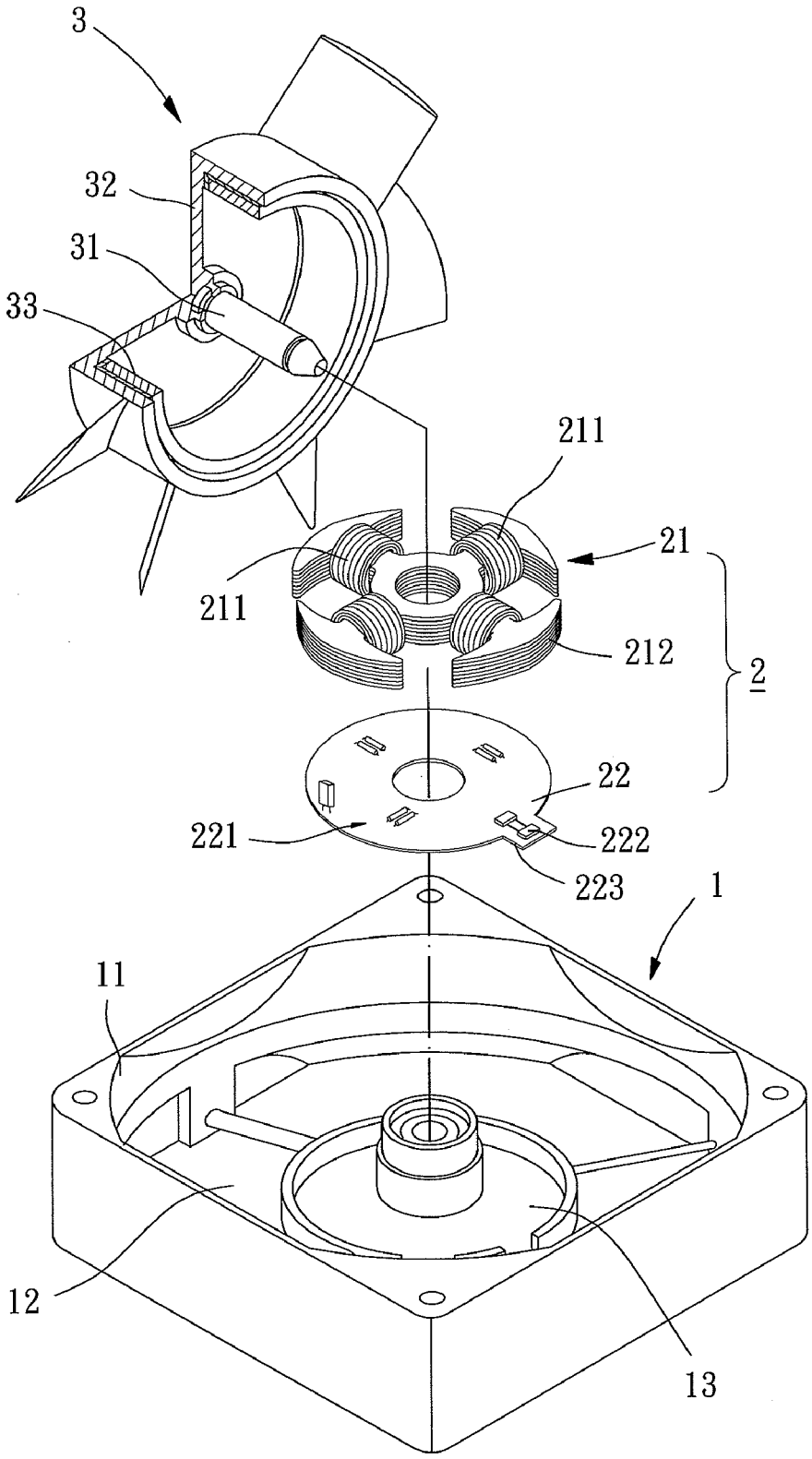
FIG. 2 is an exploded perspective view illustrating an example of a small sized heat dissipating fan of a preferred embodiment according to the preferred teachings of the present invention.

A small sized heat dissipating fan according to the preferred teachings of the present invention is shown in FIG. 2 of the drawings. According to the preferred embodiment form shown, the small sized heat dissipating fan includes a housing 1, a stator 2, and a rotor 3. The stator 2 and the rotor 3 are received in the housing 1, with the rotor 3 being able to rotate relative to the stator 2.

Specifically, the housing 1 has an air inlet 11, an air outlet 12 and a carrying base 13, with the air inlet 11 and the air outlet 12 being formed on any two side walls of the housing 1 according to the type of the small sized heat dissipating fan for air flows to pass through. The carrying base 13 is arranged in the housing 1 for holding the stator 2 and the rotor 3 inside the housing 1. As shown in FIG. 2, the small sized heat dissipating fan of the present invention is an axial fan, with the inlet 11 and the outlet 12 being arranged on two opposite side walls of the housing 1 and the carrying base 13 being fixed to an periphery of the outlet 12 and across the outlet 12.

Figure 3:
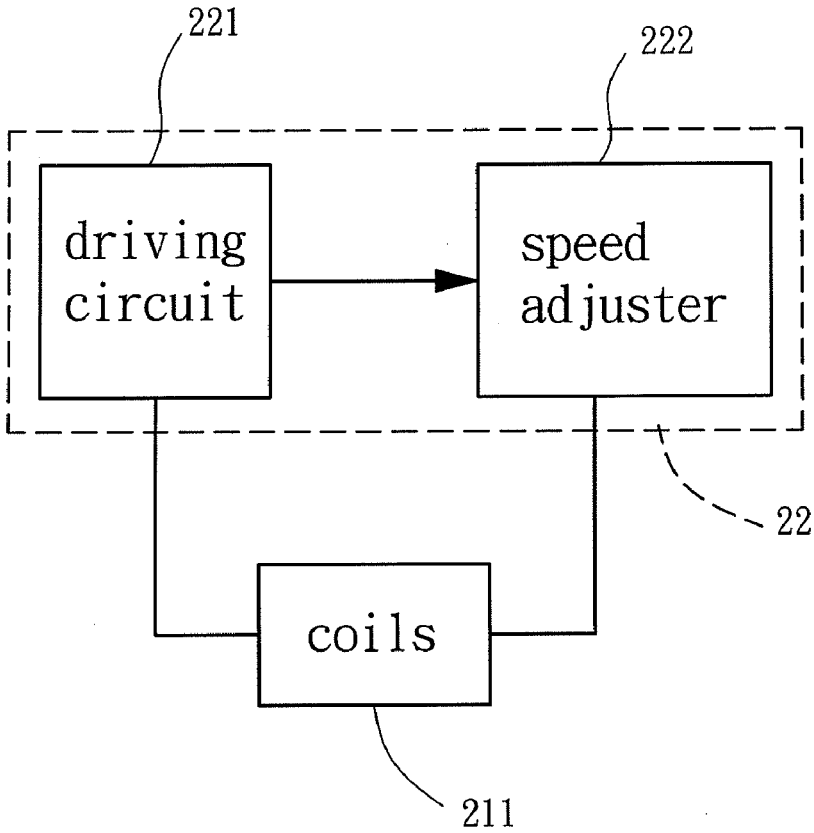
FIG. 3 is a schematic view of a circuit structure of the small sized heat dissipating fan of FIG. 2.
Figure 4:
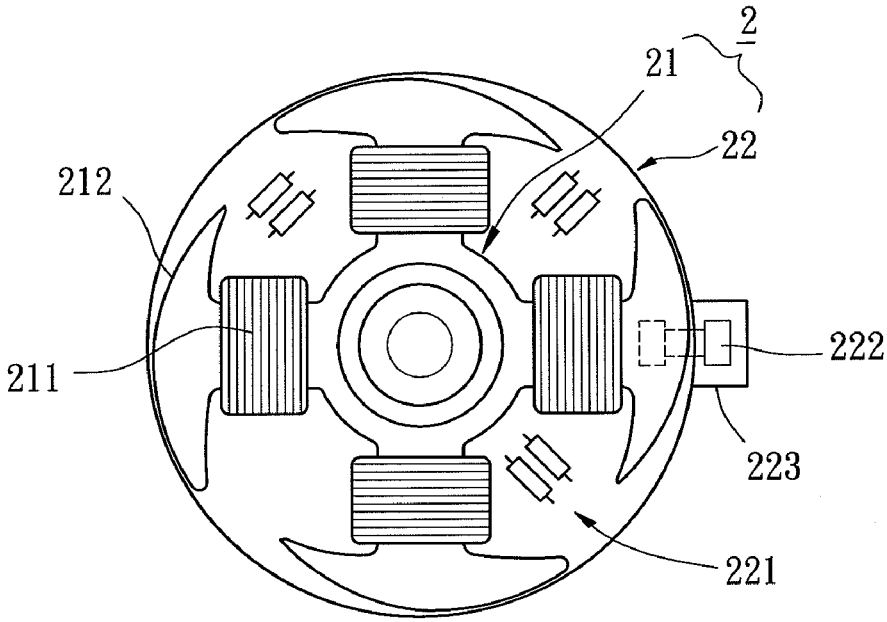
FIG. 4 is a top view illustrating a stator of the small sized heat dissipating fan of FIG. 2.
Figure 5:
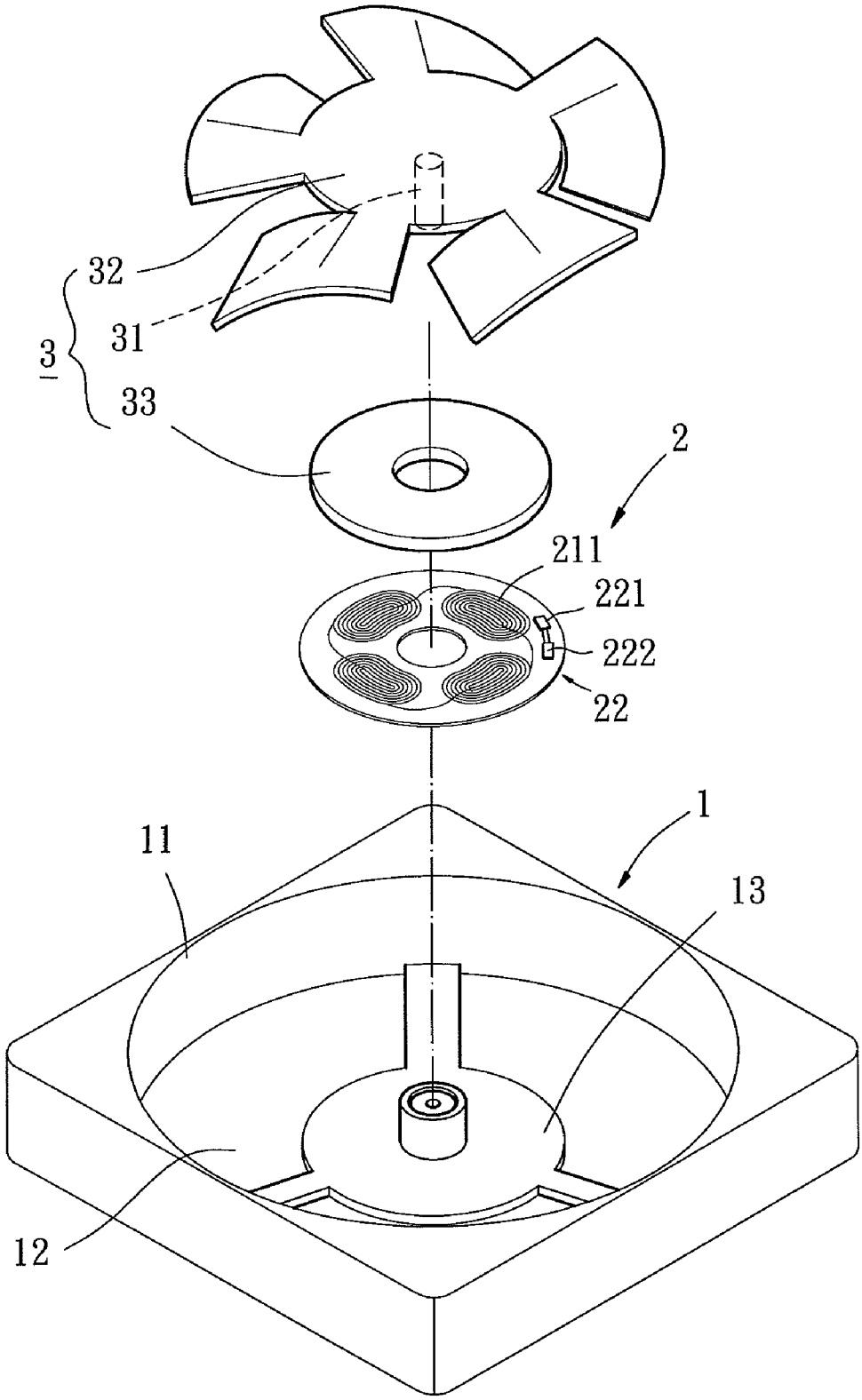
FIG. 5 is a cross sectional view illustrating another example of the small sized heat dissipating fan of the preferred embodiment according to the preferred teachings of the present invention, In the various figures of the drawings, the same numerals designate the same or similar parts. Furthermore, when the terms "end", "portion", "annular", "inner", "radial", "axial", "height", "outer" and similar terms are used hereinafter, it should be understood that these terms are reference only to the structure shown in the drawings as it would appear to a person viewing the drawings and are utilized only to facilitate describing the invention.

Still referring to FIG. 2, the stator 2 is securely mounted on the carrying base 13 and has a magnetizing member 21 with a plurality of coils 211 and a circuit board 22 electrically connecting to the coils 211. The circuit board 22 has a driving circuit 221 and a speed adjuster 222, with the driving circuit 221, the speed adjuster 222 and the coils 211 of the magnetizing member 21 electrically connecting to each other, and preferably connecting in series as shown in FIG. 3. Furthermore, the speed adjuster 222 is a resistor, selected from a chip resistor or a variable resistor, having a resistance of 0 ohm or more than 0 ohm. Referring to FIG. 4 illustrating a top plane view of the stator 2, the speed adjuster 222 is arranged outward of an outer radial edge of the magnetizing member 21. In detail, the circuit board 22 preferably has an extension 223 extending radially outward of the magnetizing member 21, with the speed adjuster 222 being disposed onto a surface of the extension 223. Besides, as shown in FIG. 2, the stator 2 and the rotor 3 of the present invention constitute a motor with a radial air gap while the coils 211 are wound around a pole plate 212 of the magnetizing member 21 and extend along several radial directions of the stator 2. However, the magnetizing member 21 can also be selected from other conventional stators for motors. For instance, an alternate form of the magnetizing member 21 of the present invention is illustrated in FIG. 5. The coils 211 constituting the magnetizing member 21 are formed on a surface of the circuit board 22 facing the rotor 3 by wiring for the stator 2 and the rotor 3 to constitute a motor with an axial air gap, such that an axial height of the stator 2 is reduced. In addition, the driving circuit 221 can be selected from a controlling IC, and the speed adjuster 222 is disposed outward of the magnetizing member 21.

The rotor 3 includes a shaft 31, an impeller 32 with a center portion thereof fixed to one end of the shaft 31, and an annular magnet 33. The other end of the shaft 31 extends through the magnetizing member 21, with the shaft 31 being rotatably coupled to the stator 2. The annular magnet 33 is mounted to an inner periphery of the impeller 32 and faces the magnetizing member 21 for reacting with an alternating magnetic field generated by the coils 211 to thereby drive the rotor 3 to turn relative to the stator 2 when the driving circuit 221 inputting a current passing through the coils 211.

In use, a rated voltage is provided by a power supply via the driving circuit 221 of the circuit board 22 and then is applied to the speed adjuster 222 and the coils 211 to generate a steady current corresponding to the resistance of the speed adjuster 222 and the coils 211. The steady current passes through the coils 211 to create an alternating magnetic field. If adjusting the rated rotational speed of the small sized heat dissipating fan is necessary, what is needed is changing the resistance of the speed adjuster 222 to decrease or increase the current passing through the coils 211. Thus, intensity of the alternating magnetic field created by the coils 211 is changed to adjust the rated rotational speed. Moreover, when the speed adjuster 222 is a variable resistor, resistance of the speed adjuster 222 can de directly adjusted according to a desired rated rotational speed. On the other hand, the speed adjuster 222 can be replaced with another resistor having a resistance different from that of the original when the speed adjuster 222 is a resistor having fixed resistance. Besides, because the position where the speed adjuster 222 disposed is out of the outer radial edge of the magnetizing member 21, when changing the rated rotational speed of the small sized heat dissipating fan of the present invention is necessary, only two processes for separating the rotor 3 from the stator 2 fixed on the base 13 and adjusting or replacing the speed adjuster 222 without an obstruction caused by the magnetizing member 21 are needed. Therefore, convenience of adjusting rated rotational speed of the small sized heat dissipating fan is provided.

As has been discussed above, the small sized heat dissipating fan of the present invention has the speed adjuster 222 that serially connects to the driving circuit 221 and the coils 211 and is of 0 ohm or more than 0 ohm to adjust the rated rotational speed of the small sized heat dissipating fan by changing the resistance of the speed adjuster 222. Further, the speed adjuster 222 is arranged outward of the outer radial edge of the magnetizing member 21 to provide convenience of replacing the resistor of the speed adjuster 222.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A small sized heat dissipating fan comprising:

a housing including a hollow interior, an air inlet, an air outlet and a carrying base arranged in the housing, with the air inlet and the air outlet being formed on any two side walls of the housing and in communication with the hollow interior;

a stator securely mounted in the hollow interior and on the carrying base and including a magnetizing member having a plurality of coils and a circuit board electrically connecting to the coils and having a driving circuit and a speed adjuster, wherein the speed adjuster is a chip resistor having a resistance of 0 ohm, with the driving circuit, the speed adjuster and the coils electrically connecting to each other, with the circuit board, the driving circuit, and the speed adjuster located in the hollow interior; and a rotor including a shaft, an impeller fixed to one end of the shaft, and an annular magnet, wherein the other end of the shaft extends through the magnetizing member while the shaft rotatably couples to the stator, with the annular magnet being mounted to an inner periphery of the impeller and facing the magnetizing member of the stator.

2. The small sized heat dissipating fan as defined in claim 1, wherein the speed adjuster is arranged outward of an outer radial edge of the magnetizing member, with the outer radial edge of the magnetizing member located radially within the hollow interior.

3. The small sized heat dissipating fan as defined in claim 2, wherein the circuit board has an extension extending radially outward of the magnetizing member, with the speed adjuster being disposed onto a surface of the extension, with the extension located radially within the hollow interior.

4. The small sized heat dissipating fan as defined in claim 1, wherein the driving circuit, the speed adjuster and the coils electrically connect to each other in series.

5. A method to assemble a small-sized heat dissipating fan comprising:

providing a housing including a hollow interior and a carrying base;

forming an air inlet and an air outlet on any two side walls of the housing, with the air inlet and the air outlet being in communication with the hollow interior;

mounting a stator securely in the hollow interior and on the carrying base, with the stator including a magnetizing member having a plurality of coils and a circuit board electrically connecting to the coils and having a driving circuit and a speed adjuster, wherein the speed adjuster is a chip resistor having a resistance of 0 ohm;

electrically connecting the driving circuit, the speed adjuster and the coils to each other;

disposing the circuit board, the driving circuit and the speed adjuster in the hollow interior;

providing a rotor including a shaft, an impeller and an annular magnet;

fixing the impeller to one end of the shaft, wherein the other end of the shaft extends through the magnetizing member while the shaft rotatably couples to the stator;

mounting the annular magnet to an inner periphery of the impeller in a direction facing the magnetizing member of the stator; and replacing the speed adjuster with a chip resistor of non-zero ohm to adjust the rotation speed.

* * * * *